US005431222A

United States Patent [19]

Bustamante

[11] Patent Number: 5,431,222

[45] Date of Patent: Jul. 11, 1995

[54] APPARATUS FOR PRODUCTION OF CRUDE OIL

[75] Inventor: Asdrubal Bustamante, Anzoategui, Venezuela

[73] Assignee: Corpoven, S.A., Caracas, Venezuela

[21] Appl. No.: 179,261

[22] Filed: Jan. 10, 1994

[51] Int. Cl.[6] ..... E21B 43/00

[52] U.S. Cl. ..... 166/105; 166/106; 166/310

[58] Field of Search ..... 166/310, 304, 369, 105, 166/68, 110, 106

[56] References Cited

U.S. PATENT DOCUMENTS

| | | | |
|---|---|---|---|
| 430,919 | 6/1890 | Campbell et al. | 166/105 |
| 2,404,930 | 7/1946 | Smith | 166/105 |
| 2,654,436 | 10/1953 | Carlisle et al. | 166/310 |
| 2,764,940 | 10/1956 | Long | 166/105 |
| 3,196,947 | 7/1965 | Van Poollen | 166/369 |
| 3,548,946 | 12/1970 | Engle | 166/310 |
| 3,822,750 | 7/1974 | Ping | 166/68 X |
| 4,366,862 | 1/1983 | Brandell | 166/106 |
| 4,573,529 | 3/1986 | Reinhardt | 166/68 |
| 4,791,985 | 12/1988 | Bermudez | 166/68 |
| 4,974,673 | 12/1990 | Chacin | 166/68 |
| 4,988,389 | 1/1991 | Adamache et al. | 166/310 X |

FOREIGN PATENT DOCUMENTS

| | | | |
|---|---|---|---|
| 615195 | 7/1978 | U.S.S.R. | 166/106 |
| 866135 | 9/1981 | U.S.S.R. | 166/105 |
| 883343 | 11/1981 | U.S.S.R. | 166/106 |
| 899866 | 1/1982 | U.S.S.R. | 166/106 |
| 1038469 | 8/1983 | U.S.S.R. | 166/68 |

*Primary Examiner*—Hoang C. Dang
*Attorney, Agent, or Firm*—Bachman & LaPointe

[57] ABSTRACT

A system for improving production of crude oil from an underground reservoir by the injection of treatment fluids includes a well casing, a production tube located within said well casing and defining therewith an annular space for receiving treatment fluids, a packer located within said annular space for isolating said annular space from a reservoir, a pump disposed in said production tube and having an inlet valve for receiving fluids to be pumped and a mixing shoe for mixing treatment fluids from said annular space with crude oil from said reservoir so as to form a substantially homogeneous mixture of said oil and said fluids in said production tube below said inlet valve of said pump.

9 Claims, 2 Drawing Sheets

APPARATUS FOR PRODUCTION OF CRUDE OIL

BACKGROUND OF THE INVENTION

The invention relates to production of crude oil from subterranean oil bearing formations and, more particularly, to an improved system, method and apparatus for mixing treatment fluids with the crude oil to improve production of the crude oil to the surface.

Various methods and systems are known for mixing diluent and other treatment fluids with a crude oil being produced so as to reduce the viscosity of the oil and thereby improve production.

Prior Art FIG. 1 shows a typical conventional system whereby diluent is pumped into the annular space of the well and mixes in the production zone with oil being produced. With this system, however, the column of diluent in the annular space exerts a pressure on the producing formation which reduces production and which can result in escape of the diluent into the formation.

Prior Art FIG. 2 illustrates another known arrangement wherein the treatment fluid is introduced through the production tube and is mixed with pumped crude oil in the production tube. The mixture then enters and is produced through the annular space through a perforated nipple located above the pump. With this arrangement, the treatment fluid does not pass through the pump which is therefore subjected to increased wear due to its operation on the highly viscous crude oil. Further, treatment fluids designed to treat the pump specifically, such as anticorrosive fluids, cannot be used.

Prior Art FIG. 3 illustrates another known arrangement wherein treatment fluid is pumped down the annular space and is metered directly into the pumping unit by a check valve. With this system, however, the check valve is frequently plugged by solids in the treatment fluid stream.

Prior Art FIG. 4 illustrates a similar approach to FIG. 3 wherein the plugging problem is addressed. However, in both of FIGS. 3 and 4, the diluent or other treatment fluid is introduced directly into the pumping chamber and, therefore, the mixture of crude oil and diluent is not homogeneous. Thus, the pump is still subjected to increased wear due to the existence of non-mixed slugs of highly viscous crude oil.

It is therefore the principal object of the present invention to provide an improved system for treating crude oil being pumped from a subterranean oil bearing formation.

It is a further object of the invention to provide a system wherein treatment fluids are mixed substantially homogeneously with crude oil to be produced before the mixture enters pumping equipment.

It is a still further object of the invention to provide such a system wherein treatment fluids are drawn through the pumping equipment.

It is another object of the invention to provide such a system wherein treatment fluids are not lost into the producing formation.

Other objects and advantages will appear hereinbelow.

SUMMARY OF THE INVENTION

The foregoing objects and advantages are readily obtained by the present invention.

In accordance with the invention, a system, method and apparatus are provided whereby treatment fluids such as diluents, anticorrosive and the like are substantially homogeneously mixed with crude oil being produced below the pumping means.

In accordance with the invention, a system is provided comprising a well casing, a production tube located within said well casing and defining therewith an annular space for receiving treatment fluids, packing means located within said annular space for isolating said annular space from a reservoir, pumping means disposed in said production tube and having an inlet valve for receiving fluids to be pumped; and mixing means for mixing treatment fluids from said annular space with crude oil from said reservoir so as to form a substantially homogeneous mixture of said oil and said fluids in said production tube below said inlet valve of said pumping means.

In further accordance with the invention, the mixing means comprises a mixing shoe located along said production tube below said pumping means, said mixing shoe comprising a substantially tubular article defining therein an inner space and having first fluid passage means for communicating said treatment fluid from said annular space to said inner space and second fluid passage means for communicating said crude oil from said reservoir to said inner space whereby said treatment fluids and said crude oil form a mixture in said mixing shoe and said mixture is drawn through said pumping means.

BRIEF DESCRIPTION OF THE DRAWINGS

A detailed description of the preferred embodiments follows, with reference to the attached drawings wherein.

DETAILED DESCRIPTION

The invention relates to the production of crude oil from subterranean oil bearing formations and, more particularly, to an improved system, method and apparatus for mixing treatment fluids with crude oil so as to improve production of the crude oil and to reduce wear on the pumping equipment.

FIGS. 1 through 4 illustrate prior art approaches, discussed above, which are improved upon by the present invention.

Figure 5:
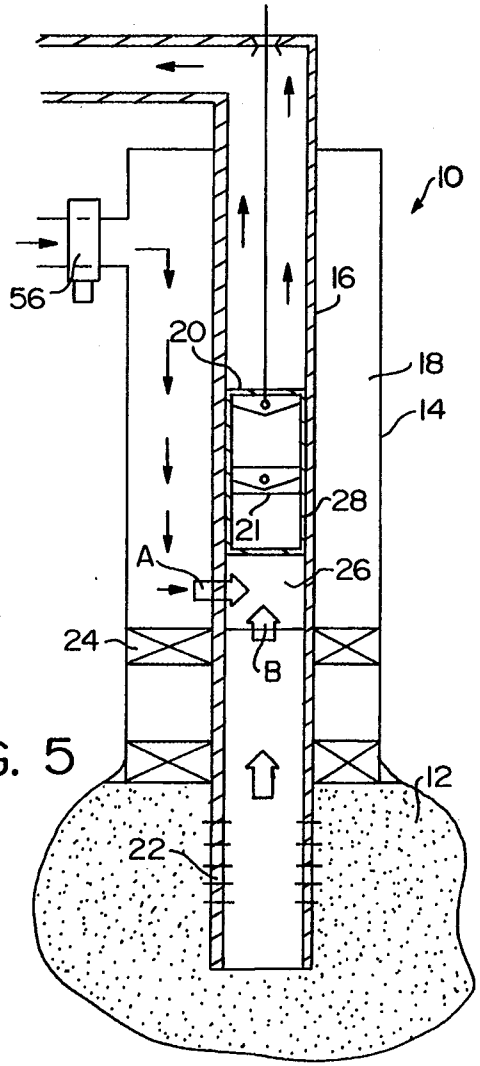
FIG. 5 schematically illustrates a system in accordance with the invention.

FIG. 5 illustrates a system wherein a well 10 is set into a producing formation 12. Well 10 has a well casing 14 (schematically shown) with a production tube 16 located therein and defining therebetween an annular space 18. A pump 20 is disposed within tube 16 so as to enhance the flow of crude oil from formation 12, through perforations 22 of casing 14, and up through tube 16 and pump 20 for production to the surface. Pump 20 has an inlet valve 21 for intake of fluids to be pumped to the surface.

Crude oils may be very viscous and therefore cause numerous problems with pumping equipment which must pump the crude oil. With crude oil having an API gravity below about 14°, pumps, rods and other pumping equipment can be rapidly worn out. This causes down time for maintenance or replacement of equipment, and also adds the cost of replacement equipment to the cost of producing the oil.

Diluent fluids and other treatment fluids have been used to reduce the viscosity of the crude oil so that pumping of the treated crude oil is easier. Prior Art FIGS. 1–4 illustrate various approaches to introducing the treatment fluid to the well, each having drawbacks as set forth above.

In accordance with the present invention, a packer 24 is set within annular space 18 so as to isolate annular space 18 from formation 12. A mixing shoe 26 is provided along tube 16, below pump 20 and above packer 24. Treatment fluids can thereby be injected into annular space 18 for mixing with crude oil in mixing shoe 26 so as to thoroughly mix the treatment fluid with the oil before the mixture enters inlet valve 21 of pump 20 and is pumped. In accordance with the invention, mixing shoe 26 is preferably spaced sufficiently below pump 20 so that the treatment fluid and crude oil have sufficiently mixed before the mixture enters pump 20 so that the mixture has a reduced viscosity and therefore causes less problems while being pumped.

In accordance with the invention, suitable mixing may be obtained by providing a spacer 28 between mixing shoe 26 and pump 20. Spacer 28 is provided having a length selected so that the mixture of diluent and crude oil is substantially homogeneous when it reaches inlet valve 21 of pump 20. Of course, the length of spacer 28 will vary depending upon the qualities of the oil and treatment fluids and also upon the operating conditions of the pumping procedure. Spacer 28 may generally include, for example, two or more sections of 30 foot pipe. It is also preferable that spacer 28 be provided having a length which does not result in interference with the pumping procedure due to the column of liquid in spacer 28 below pump 20.

As schematically shown in FIG. 5, mixing shoe 26 serves to communicate treatment fluid (arrow A) from annular space 18 into mixing shoe 26, where the fluid mixes with crude oil (arrow B) flowing upwardly into mixing shoe 26 from formation 12.

In accordance with a preferred embodiment of the invention (See FIG. 6), mixing shoe 26 comprises a substantially tubular article 30 having connector means 32 at one end for connection to production tube 16 (or to spacer 28). Shoe 26 has at least one aperture 34 arranged in a wall 36 of article 30 for allowing flow of treatment fluid into mixing shoe 26. Shoe 26 also includes a check valve 38 arranged within shoe 26. Check valve 38 preferably includes a seating ring 40 disposed within shoe 26 and providing a seat structure for a valve body 42 which is preferably a spherical member sized to removably rest on seating ring 40.

A cage member 44 is preferably provided within shoe 26 to confine or limit the movement of valve body 42 out of seating ring 40 while allowing flow of fluids therethrough. Thus, valve body 42 is displaceable between a blocking or closed position where it is sealingly seated in the opening 46 of seating ring 40, and an unblocking or open position where valve body 42 is displaced out of seating ring 40 into an inner area of cage member 44. In the open position, flow of crude oil upwardly from an inlet end 48 of shoe 26 is allowed to pass through check valve 38 to mix with treatment fluid entering apertures 34. Valve body 42 is displaced into the open position by the pulling action of pump 20.

When pump 20 is not pulling on valve body 42, valve body 42 drops to the closed position so that treatment fluid entering shoe 26 through apertures 34 cannot escape downwardly out of inlet 48 and into the formation.

Figure 4:
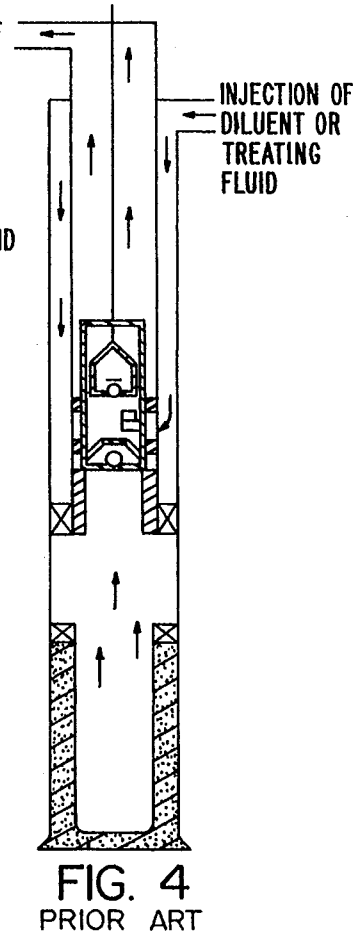
FIG. 4 PRIOR ART
FIG. 1 through 4 illustrate prior art systems.
Figure 3:
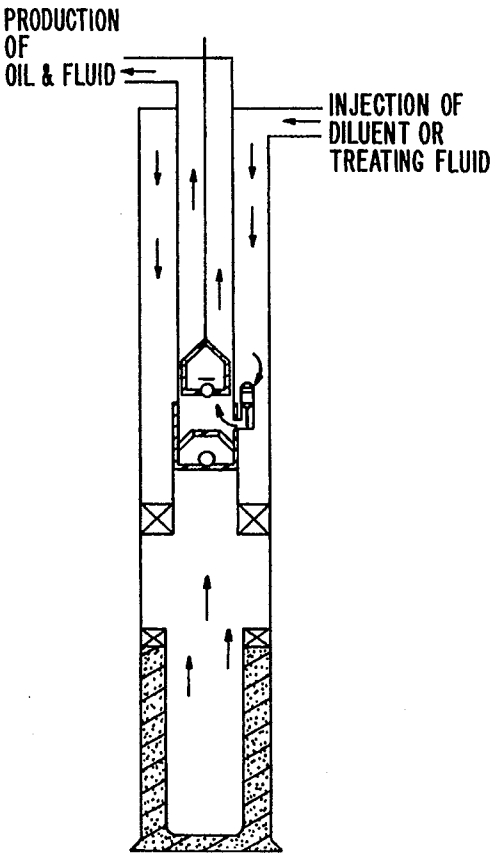
FIG. 3 PRIOR ART
Figure 2:
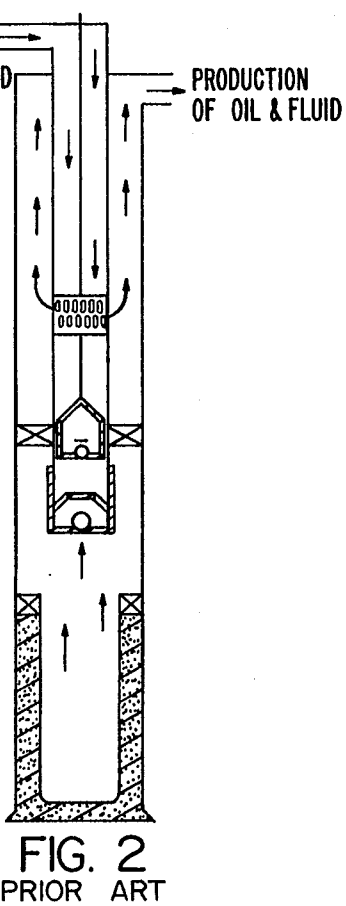
FIG. 2 PRIOR ART
Figure 1:
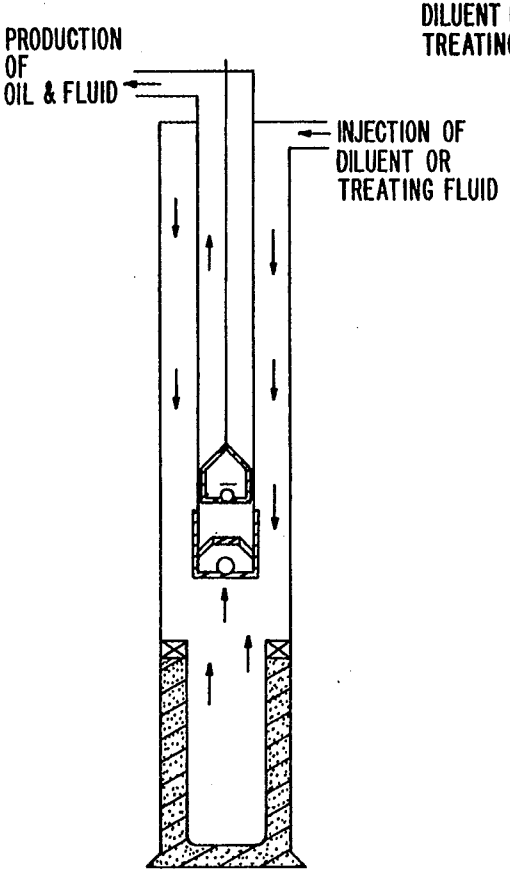
FIG. 1 PRIOR ART
Figure 6:
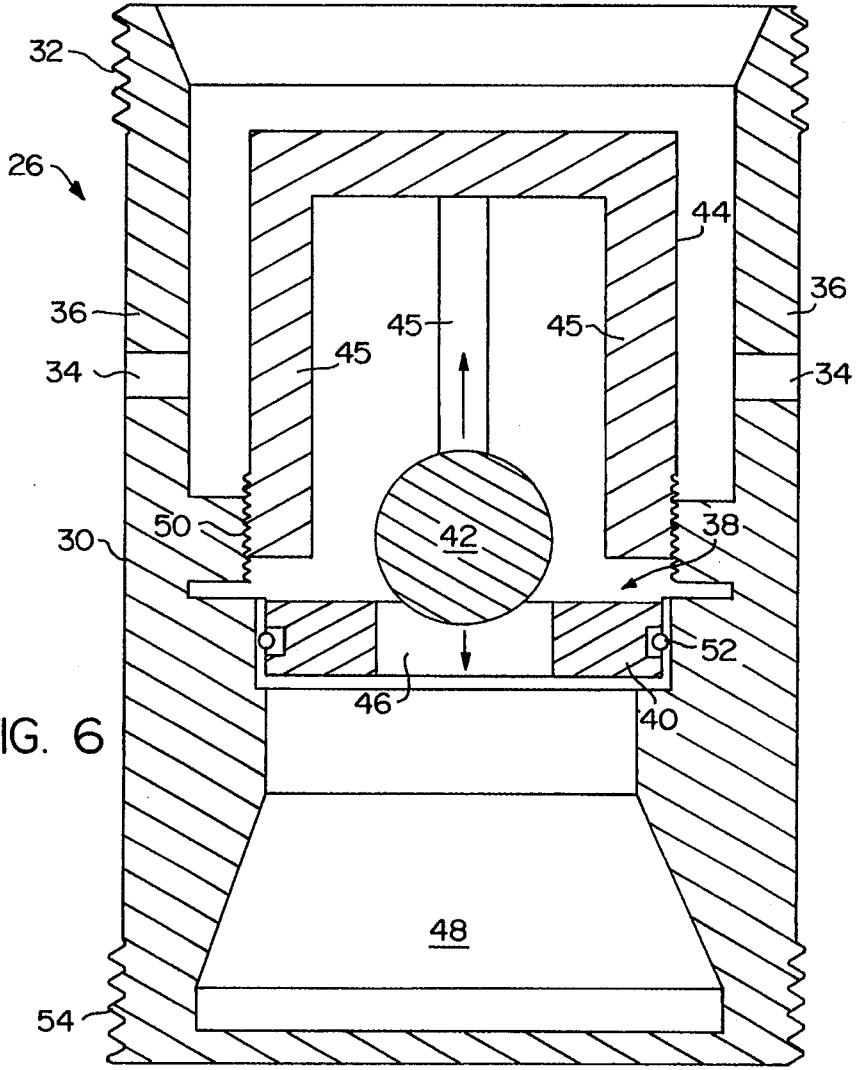
FIG. 6 illustrates a mixing shoe in accordance with the present invention.

Cage member 44 is preferably any type of wire, mesh or bar structure which may be desired for holding valve body 42 in place while allowing fluid flow therethrough. FIG. 6 shows a section of a cage having four bars 45 spaced to confine valve body 42. Cage member 44 may suitably be held in place within shoe 26 by thread means 50 or in any other manner.

Seating ring 40 is preferably sealingly disposed within shoe 26 so that, when valve body 42 is in the closed position, fluid flow around seating ring 40 is prevented. This may be accomplished, for example, with sealing member 52 as shown in FIG. 6 or through any other suitable arrangement.

Shoe 26 may also have additional connector means 54 for connecting the bottom or inlet end 48 of shoe 26 to further sections of production tube 16 which may be set directly into formation 12.

It should be noted, of course, that check valve 38 is a preferred embodiment and that numerous other check valve structures could suitably be substituted for check valve 38 so long as the valve selected can be opened by operation of the pump from above, and also providing that the closed check valve prevents flow into formation 12 or, in other words, that the check valve is operative to allow flow only from the reservoir into mixing shoe 26, and not vice versa.

As set forth above, mixing shoe 26 and spacer 28 serve to introduce treatment fluid from annular space 18 into the flow of crude oil in production tube 16 in such a manner that turbulence causes a substantially homogeneous mixing of the treatment fluid and the oil. This mixing serves to provide the intended reduction in viscosity of the crude oil so that production of same is facilitated. Further, the mixing is conducted below the pump so that the pump operates on a mixture of fluids and oil which is significantly easier to pump, thereby reducing wear on the pump and rendering the entire procedure more efficient.

The type and amount of treatment fluid to be injected depends of course upon the nature of the crude oil and also upon the desired characteristics of the resulting mixture. The type of treatment fluid may be selected based upon whatever characteristic of the crude oil is to be adjusted. Typically, diluent or other light fluid such as gasoline, diesel, kerosene, light and medium weight crude oils and mixtures thereof may be added to reduce the weight and viscosity of the crude oil being produced. The treatment fluid may also be added as an anti-corrosive or for any other purpose.

The amount of fluid added may conveniently be controlled from the surface by an adjustable choke 56 disposed along the fluid supply line, or in any other suitable and desirable manner.

Thus provided is a system, method and apparatus for producing crude oil from a subterranean formation wherein treatment fluids are efficiently and effectively introduced into the crude oil so as to obtain full benefit of the viscosity and weight reducing qualities of the treatment fluid, and other benefits such as corrosion control and the like.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A system for improving production of crude oil from an underground reservoir by the injection of treatment fluids, comprising:

a well casing;

a production tube located within said well casing and defining therewith an annular space for receiving treatment fluids;

packing means located within said annular space for isolating said annular space from a reservoir;

pumping means disposed in said production tube and having an inlet valve for receiving fluids to be pumped; and mixing means for mixing treatment fluids from said annular space with crude oil from said reservoir so as to form a substantially homogeneous mixture of said oil and said fluids in said production tube below said inlet valve of said pumping means, said mixing means comprises a mixing shoe located along said production tube below said pumping means, said mixing shoe comprising a substantially tubular article defining wherein an inner space and having first fluid passage means for communicating said treatment fluid from said annular space to said inner space and second fluid passage means for communicating said crude oil from said reservoir to said inner space whereby said treatment fluids and said crude oil form a mixture in said mixing shoe and said mixture is drawn through said pumping means and wherein said second fluid passage means comprises check valve means arranged in said mixing shoe below said first fluid passage means for selectively allowing flow of said oil from said reservoir to said inner space whereby flow of said treatment fluid into said reservoir is prevented.

2. A system according to claim 1, wherein said first fluid passage means comprises at least one radial flow passage formed in a side wall of said mixing shoe.

3. A system according to claim 1, wherein said check valve means comprises a seating ring disposed within said mixing shoe, a substantially spherical valve body seated on said seating ring, and cage means disposed within said mixing shoe above said seating ring to limit movement of said valve body between a seated position wherein flow through said check valve means is blocked, and an unseated position wherein flow through said check valve means is not blocked.

4. A system according to claim 3, wherein operation of said pumping means pulls said valve body into said unseated position within said cage means.

5. A system according to claim 3, wherein said cage means comprises a cage member for permitting flow of said crude oil and said treatment fluids while retaining said valve body within said cage member.

6. A system according to claim 1, further including spacer means disposed between said pumping means and said mixing means for providing further mixing of said treatment fluids and said crude oil before said mixture reaches said pumping means.

7. A system according to claim 6, wherein said spacer means comprises a substantially tubular article disposed along said production tube between said pumping means and said mixing means and having a length sufficient to provide a substantially homogeneous mixture of said treatment fluids and said crude oil at an inlet to said pumping means.

8. A system according to claim 1, further including means for supplying said treatment fluids to said annular space, and adjustable choke means associated with said treatment fluids supplying means for controlling the amount of treatment fluids supplied to said annular space.

9. A system according to claim 1, wherein said pumping means is selected from the group consisting of mechanical pumps, reciprocating pumps, centrifugal pumps, piston pumps, rod pumps, electrical submersible pumps and progressive cavity pumps.

* * * * *

UNITED STATES PATENT AND TRADEMARK OFFICE

CERTIFICATE OF CORRECTION

PATENT NO. : 5,431,222

DATED : July 11, 1995

INVENTOR(S) : Asdrubal Bustamante

It is certified that error appears in the above-indentified patent and that said Letters Patent is hereby corrected as shown below:

Claim 1, column 5, line 23, "wherein" should be --therein--.

Signed and Sealed this

Fifth Day of December, 1995

*Attest:*

Bruce Lehman

BRUCE LEHMAN

*Attesting Officer*

*Commissioner of Patents and Trademarks*